US005274358A

United States Patent [19]

Janis

[11] Patent Number: 5,274,358

[45] Date of Patent: Dec. 28, 1993

[54] PERSONAL SAFETY DEVICE HAVING MICROPROCESS CONTROL AND METHOD FOR OPERATING THE SAME

[75] Inventor: Bruce A. Janis, San Francisco, Calif.

[73] Assignee: Egis Personal Safety Systems, Sunnyvale, Calif.

[21] Appl. No.: 947,349

[22] Filed: Sep. 18, 1992

Related U.S. Application Data

[63] Continuation of Ser. No. 761,477, Sep. 17, 1991, Pat. No. 5,196,829.

[51] Int. Cl.[5] ..... G08B 13/00

[52] U.S. Cl. ..... 340/574; 341/384 E; 341/691; 341/693

[58] Field of Search ..... 340/574, 384; 116/DIG.

[56] References Cited

U.S. PATENT DOCUMENTS

| | | | |
|---|---|---|---|
| D. 260,008 | 7/1981 | Wistrand | D10/106 |
| D. 283,684 | 5/1986 | Francis | D10/106 |
| D. 283,806 | 5/1986 | Harris | D10/106 |
| D. 317,579 | 6/1991 | Shalvi | D10/101 |
| D. 325,357 | 4/1992 | Worthington | D10/106 |
| 3,171,109 | 2/1965 | Appel | 340/521 |
| 4,303,908 | 12/1981 | Enemark et al. | 340/384 E |
| 4,386,341 | 5/1983 | Yamamoto | 340/384 E |
| 4,418,334 | 11/1983 | Burnett | 340/332 |
| 4,566,085 | 1/1986 | Weinberg | 367/139 |
| 4,602,245 | 7/1986 | Yang et al. | 340/384 R |
| 4,660,027 | 4/1987 | Davis | 340/636 |
| 4,668,937 | 5/1987 | Shota | 340/384 E |
| 4,724,424 | 2/1988 | Nakashima et al. | 340/384 E |
| 4,810,996 | 3/1989 | Glen et al. | 340/321 |
| 4,980,837 | 12/1990 | Nunn et al. | 364/484 |
| 5,012,221 | 4/1991 | Neuhaus et al. | 340/384 E |

FOREIGN PATENT DOCUMENTS

| | | | |
|---|---|---|---|
| 2042230 | 9/1980 | United Kingdom | 340/574 |

OTHER PUBLICATIONS

A facsimile of Eversafe and its product literature packaging manufactured by Eveready Battery Company, Inc. of Saint Louis, Mo.

A facsimile of the Performance Megahorn and its product literature packaging manufactured by Performance of Chapel Hill, North Carolina.

A facsimile of the Quorum PAAL Personal Attack Alarm and its product iterature packaging manufactured by Quorum International, Ltd. of Scottsdale, Arizona.

A facsimile of the Screamer and its product literature packaging manufactured by Qualco Products Co. of Fanwood, New Jersey.

A facsimile of the National 110 BH-204P and its product literature packaging.

A facsimile of the Ramcon Sonicguard and its product literature packaging.

A facsimile of the Scream-Alarm and its product literature packaging manufactured in Maitland, Florida.

A facsimile of My Alarm and its product literature packaging.

A facsimile of The Guardar Personal Alarm Light and its product literature packaging.

A facsimile of the Panic Button and its product literature packaging manufactured by Clairol Inc. of Stanford, Connecticut.

*Primary Examiner*—Glen R. Swann, III

*Attorney, Agent, or Firm*—Blakely, Sokoloff, Taylor & Zafman

[57] ABSTRACT

A personal safety device controlled by a microprocessor which responds to commands, such as activation and deactivation commands. The microprocessor acts to control sound emitted from two separate speakers. The sound is controlled through digital outputs of the microprocessor such that the sound emitted by the first speaker has a first sinusoidal component sin(a) and the sound emitted by the second speaker has a second sinusoidal component sin(b) yielding a complex tone when perceived by a human ear. The personal safety device further allows for coded deactivation thereby rendering it difficult for a third-party without knowledge of the code, such as a would-be attacker, to deactivate the device. Further, the personal safety device provides a detection circuit for detecting a low battery condition. Finally, a method for operating the device is disclosed.

53 Claims, 10 Drawing Sheets

Power on
1201
Test switch status
1202
Activate switch active?
1203
Yes
No
Reset switch active?
1204
No
Test good?
1206
Yes
No
Sound "good" beep 1208
Sound "bad" beep 1207
Retest every 15 minutes 1211
Power off 1219
Read deactivate code
1213
Start sound pattern
1214
Reset switch active?
1215
Yes
No
Branch on code
1216
1
2
3
Branch on condition 1218
Branch on code 1221
Branch on code 1217
R
A
T
Lockout deactivation 1220

PERSONAL SAFETY DEVICE HAVING MICROPROCESS CONTROL AND METHOD FOR OPERATING THE SAME

This is a continuation of application Ser. No. 07/761,477, filed Sep. 17, 1991, now U.S. Pat. No. 5,196,829.

BACKGROUND OF THE INVENTION

1. Field of the Invention

The present invention relates to the personal safety devices and, more specifically, to devices for providing an alarm or distress signal upon activation by the user in order to, for example, deter an attack or to summon assistance.

2. Description of the Related Art

There are a large number of personal safety devices currently available. These devices may be generally thought of as falling into two categories: (1) weapons, such as guns, mace, etc.; and (2) alarm and similar deterrence devices such as devices which produce audible alarms when activated by the user. The preferred embodiment of the present invention falls into the latter category.

In reviewing alarm products which are currently commercially available, a number of shortcomings have been noted. It is an object of the present invention to overcome such shortcomings. Perhaps, these shortcomings will be best understood by detailing what is now considered to be desirable features of a personal safety device.

(1) The device should produce an audible signal which will deter an attacker. It is desirable that the audible signal itself be offensive to the hearing of an attacker, rather than simply causing the attacker to fear having attention brought to the attack by the signal. In this way, the attacker may terminate the attack even if there is no other persons within hearing range to respond to the signal;

(2) The device should produce an audible signal which will attract the attention of other persons who may come to the aid of the user of the device. To this end it is desirable for the device to produce an audible signal which can be heard at relatively long distances and which will attract the attention of other persons. It is also desirable to produce an audible signal which differentiates from other alarms found in today's products such as car alarms, smoke detectors, home security alarms, etc.;

(3) The device should be easy to carry in a manner which allows it to be readily available for activation;

(4) The device should be easy to activate in unexpected circumstances. It is desirable for the device to be designed to allow activation when held in any of a number of orientations and, further, that the device be activated easily, for example, through some natural or intuitive response to an emergency situation;

(5) The device should be difficult for persons other than the intended user to deactivate;

(6) The device should be easily deactivated by the intended user so that, for example, it may be shut-off readily if accidently activated or if the user determines the audible signal produced by the device is escalating the level of an attack; and (7) The device should be designed to prevent false activations (false alarms) from occurring.

Turning back to the known commercially available products, these products generally do not adequately provide for the above-described desirable features. For example, such known commercial products do not provide for an audible signal which is sufficient to deter an attack either due to having insufficient volume, poor sound composition to accomplish deterrence, or both.

Further, the sounds produced by such devices tend to be similar to sounds produced by other types of alarms (e.g., car alarms, home burglar alarms, etc.), thus not providing a distinguishable sound which is likely to draw the attention of persons who might come to the assistance of the user of the device.

Still further, known devices do not provide adequate methods for activation of the device. Lack of adequate methods of activation may render the device ineffective in many situations. Even if activated, such devices are often easily deactivated by an attacker. Other devices may be more difficult for an attacker to deactivate but prove to be difficult for the intended user of the device to deactivate also.

Examples of known activation methods include a simple switch. A simple switch is, of course, relatively easy to activate by the intended user of the device, if the device is properly oriented at the time when the user wishes to activate the device. However, in the likely event that the device is not properly oriented in the users hand at the time the user wishes to activate the device, the user must use valuable seconds orienting the device before it can be activated. Another example of an activation mechanism is a pull string or lanyard which is pulled out of the device in order to activate it. This type of activation mechanism typically requires two hands to activate—one to pull on the string and the other to hold onto the device. Further, if accidently activated, the device requires a certain amount of coordination to reinsert the string in order to deactivate the device. If the string is misplaced, deactivation is even more difficult.

It is also noted that removal of batteries from the known devices is relatively simple and that such removal will result in deactivation of the device.

One specific device is described in U.S. Pat. No. 4,264,892 titled Alarm Device. This device is described as a multipurpose device which may be activated by use of a manually operated switch or, alternatively, by use of a circuit which includes a switch which is closed, for example, upon detecting heat (such as fire) or upon detect movement (such as movement of a door). The manual switch located along one side of the unit and is described as being of the double-throw type in which one position is neutral position, one position causes a light bulb to light and one position causes an alarm to sound. Therefore, as understood, the described device requires orientation of the device in a manner such that a finger can rotate the manual switch in one direction in order to activate the device. Further, the device may be easily deactivated by simply moving the switch back to its normal position. Still further, the sound produced by the device is simply described as a loud noise; however, there is no teaching of the sound characteristics disclosed by the present invention which lead to both deterrence of an attacker and attraction of third-parties. The sound making device is described as having a screw-threaded adjustment means for adjustment purposes.

These and other objects of the present invention will be better understood with reference to the Detailed Description of the Preferred Embodiment, the accompanying drawings, and the claims.

SUMMARY OF THE INVENTION

A personal safety device is described. In addition, a method for operating the device is described.

The personal safety device is preferably of what will be referred to as a dog bone shaped design—that is, the device is formed with a center cylindrical or tubular section. having ends which are of a greater diameter than the diameter of the central tubular section. Each end of the device houses a speaker for emitting sound when the device is activated. The center portion houses various circuitry including a microprocessor used for controlling the device. The circuitry will be described in greater detail herein. The center portion further houses batteries used for powering the device.

The dog bone design has been exploited to provide for a number of advantages which will be more completely understood for the below Detailed Description. However, briefly, it might be summarized here that the design has been exploited to provide for at least the following advantages:

(1) the speakers are placed to focus sound in directions generally opposite of each other thereby providing for broader sound coverage than with known personal safety devices employing, for example, a single speaker;

(2) the speakers are placed sufficiently far apart such that a human hand cannot cover both speakers at the same time thereby making it difficult to cover the both speakers simultaneously with a single hand in order to muffle the sound emitted by the speakers; and (3) the device is activated by gripping (or, possibly, more appropriately squeezing) depressing a bar located on the tubular central section of the device—by locating the bar on the tublar central section, the bar is readily accessible by the user when the device is held in any of a number of natural orientations.

As has been stated, the personal safety device of the present invention is controlled by a microprocessor housed in the central portion of the dog bone housing. Before continuing by briefly describing certain features which are provided in the device of the present invention through exploitation of the microprocessor control, it is noted that although microprocessor technology has been now long known in the art, the usefulness of such technology has been herebefore unrecongnized in the art of the type of device described herein. Rather, known devices have simply relied on simple switching schemes to control activation and deactivation of sounds produced by such devices. The present invention goes even beyond discovery of the general usefulness of microprocessors in this type of device and has discovered that, once employed in the device, the microprocessor is useful for provide a number of advantageous functions including:

(1) the microprocessor may be utilized to produce digital signals which result in complex and unique tones being produced by the device;

(2) the microprocessor may be utilized to control deactivation of the device such that, once activated, the device can only be deactivated by a person knowing and entering a predetermined deactivation code; and (3) the microprocessor may be utilized, in conjunction with detection circuitry disclosed herein, to detect and notify of certain faulty conditions in the device such as a low battery; and (4) the microprocessor may control activation, as will be described, in order to avoid false alarms or false activations.

The present invention further discloses generation of a unique noise which has the effect of being perceived by a listener as a confusing cacophony at close range while being perceived as set of relatively independent sound signals at a greater distance. It is anticipated that this signal will have the effect of deterring persons within a close proximity of the device (such as a would-be attacker) while attracting persons further away from the device (such as a would-be rescuer).

The present invention still further discloses a unique speaker design which readily produces loud sounds and, further, utilizes relatively inexpensive piezoelectric transducer technology.

These and other aspects of the present invention will be apparent to one of ordinary skill in the art with further reference to the below Detailed Description of the Preferred Embodiment and the accompanying drawings.

Figure 1:
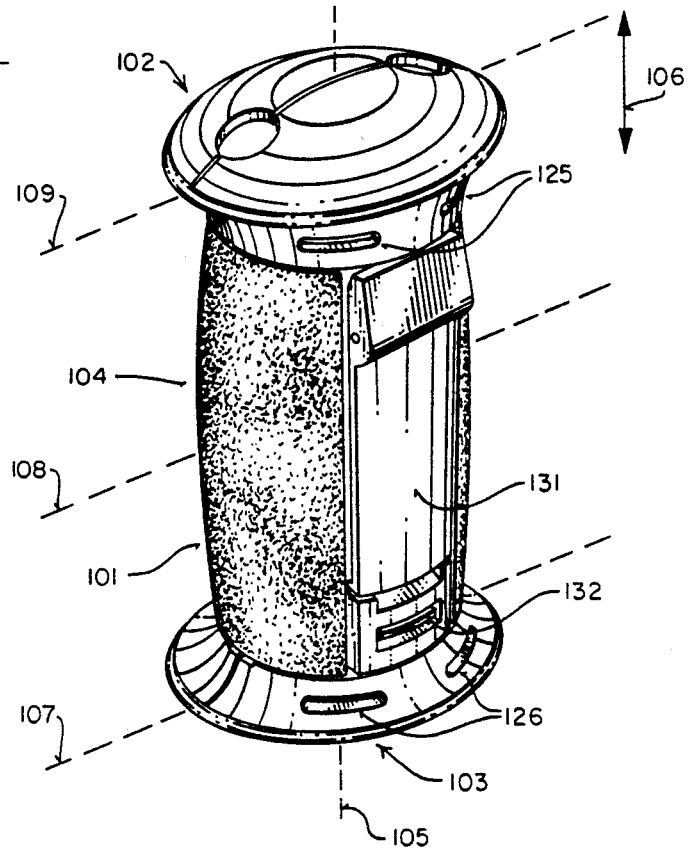
FIG. 1 is a top, front and left side perspective view of the personal safety device of the present invention.
Figure 2:
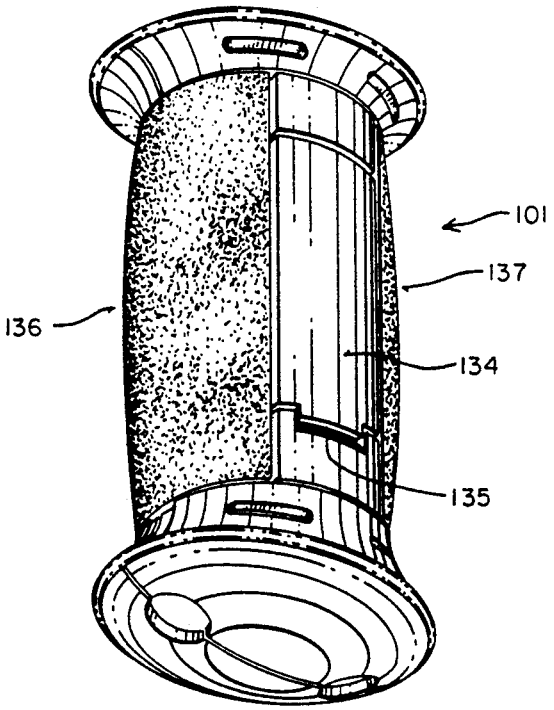
FIG. 2 is a bottom, back and right side perspective view of the personal safety device of the present invention.
Figure 3:
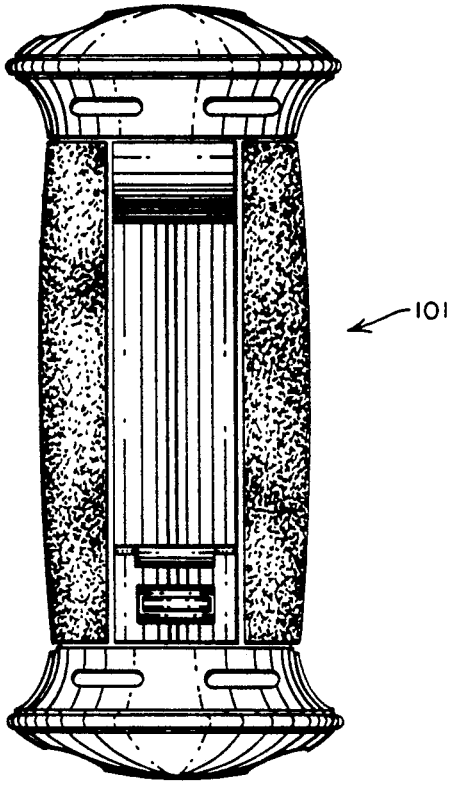
FIG. 3 is a front side view of the personal safety device of the present invention.
Figure 4:
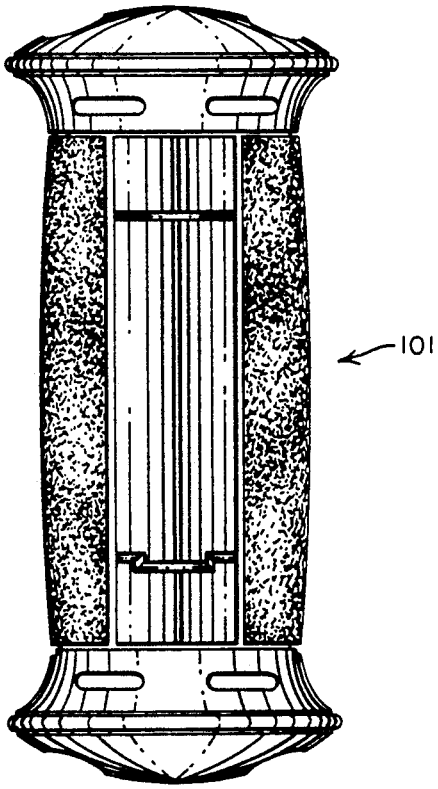
FIG. 4 is a back side view of the personal safety device of the present invention.
Figure 5:
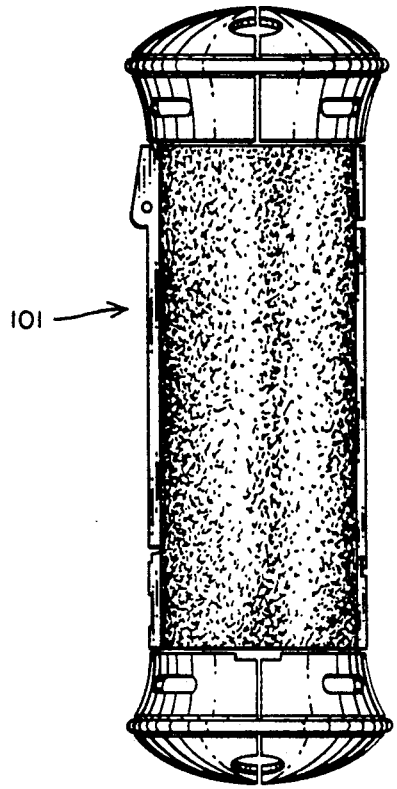
FIG. 5 is a left side view of the personal safety device of the present invention.
Figure 6:
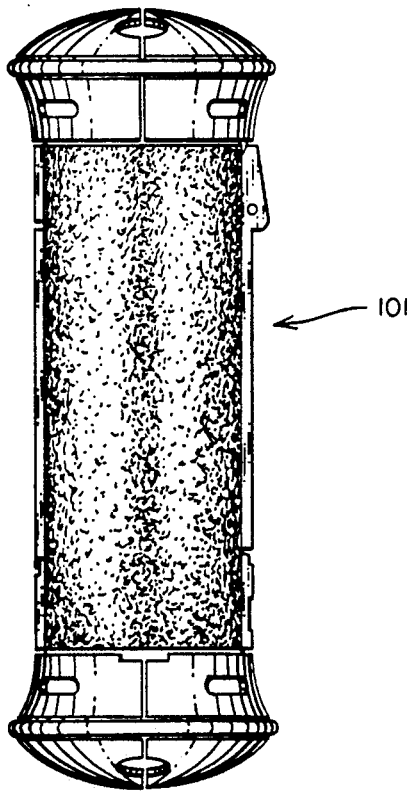
FIG. 6 is a right side view of the personal safety device of the present invention.

For ease of reference, it might be pointed out that reference numerals in all of the accompanying drawings typically are in the form "drawing number" followed by two digits, xx; for example, reference numerals on FIG. 1 may be numbered 1xx; on FIG. 3, reference numerals may be numbered 3xx. In certain cases, a reference numeral may be introduced on one drawing and the same reference numeral may be utilized on other drawings to refer to the same item.

DETAILED DESCRIPTION OF THE PREFERRED EMBODIMENT

What is described herein is a personal safety device which provides for deterrence of attackers as well as providing a signal useful for attracting the attention of third-parties when the user of the device requires assistance. In the following description, numerous specific details are set forth in order to provide a thorough understanding of the present invention. It will be obvious, however, to one skilled in the art that the present invention may be practiced without these specific details. In other instances, well-known circuits, structures and techniques have not been shown in detail in order not to unnecessarily obscure the present invention.

OVERVIEW OF THE PERSONAL SAFETY DEVICE OF THE PRESENT INVENTION

The preferred embodiment of the present invention is embodied in a personal safety device which provides for emitting a loud sound upon activation. The design of the housing of the device may be though of as being roughly in the shape of a bone and, therefore, the shape of this housing is referred to herein as a dog bone shape. It will be shown below that the present invention takes advantage of this shape in order to provide for a number of advantages. Further, the device is preferably controlled by a microprocessor. The present invention takes advantage of controlling the device with the microprocessor to provide for several inventive advantageous features. Finally, the present invention provides for a unique acoustic signal and acoustic design for speakers utilized by the device. Each of these features of the present invention will be described in greater detail below.

THE DOG BONE DESIGN

As has been stated, the personal safety device of the present invention is preferably housed in a dog bone shaped housing. This housing 101 is illustrated with reference to FIGS. 1–8.

Overview

Figure 9:
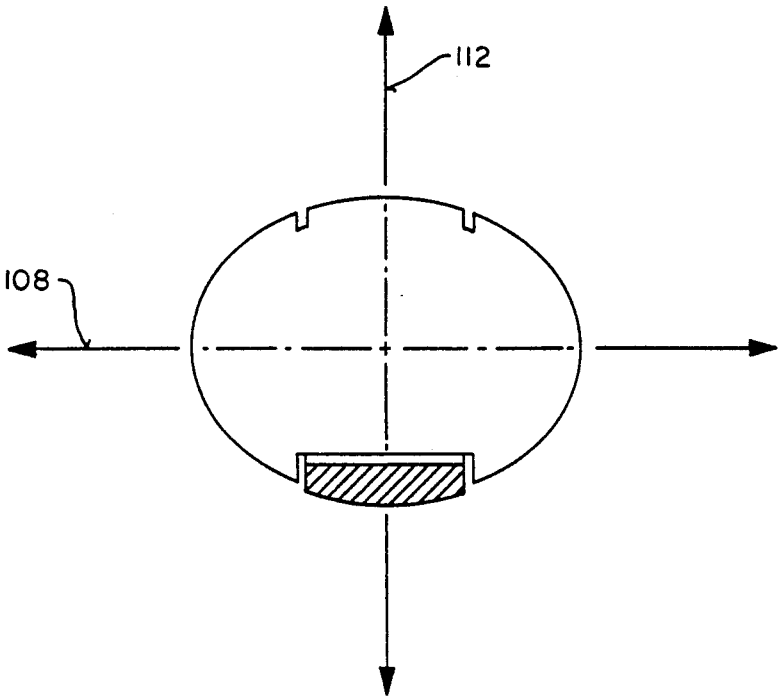
FIG. 9 is a cross-sectional view of the personal safety device.

The dog bone design provides a generally cylindrical or tubular mid-section 104. In its preferred embodiment the device may be most properly described as a oval cylinder. A cross-section of the mid-section 103 of the device is shown with reference to FIG. 9 which illustrates the mid-section 103 as having a first dimension of approximately 42 millimeters along a first axis 108. The mid-section's oval dimension along axis 112 is approximately 30 millimeters. The mid-section 103 preferably measures approximately 77 millimeters (sometimes referred to herein as the device's first dimension) along a first axis 105.

Figure 7:
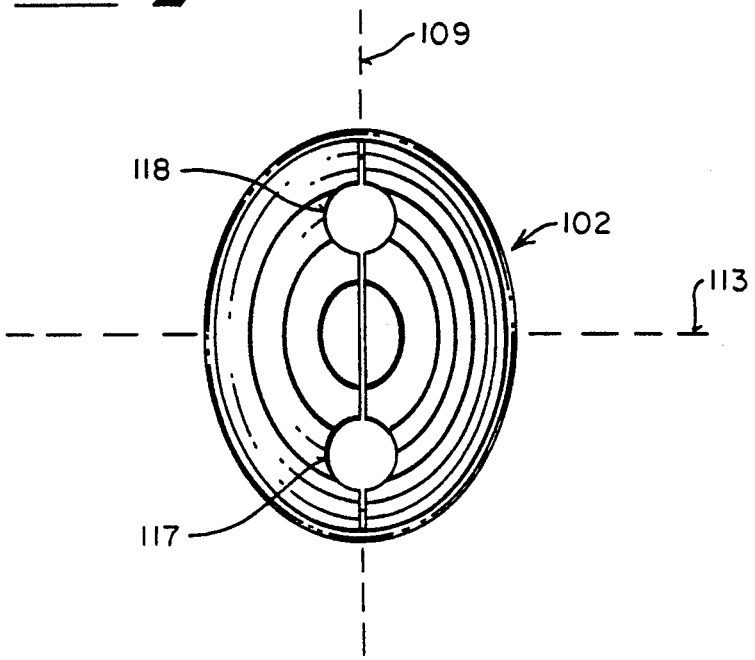
FIG. 7 is top view of the personal safety device of the present invention.
Figure 8:
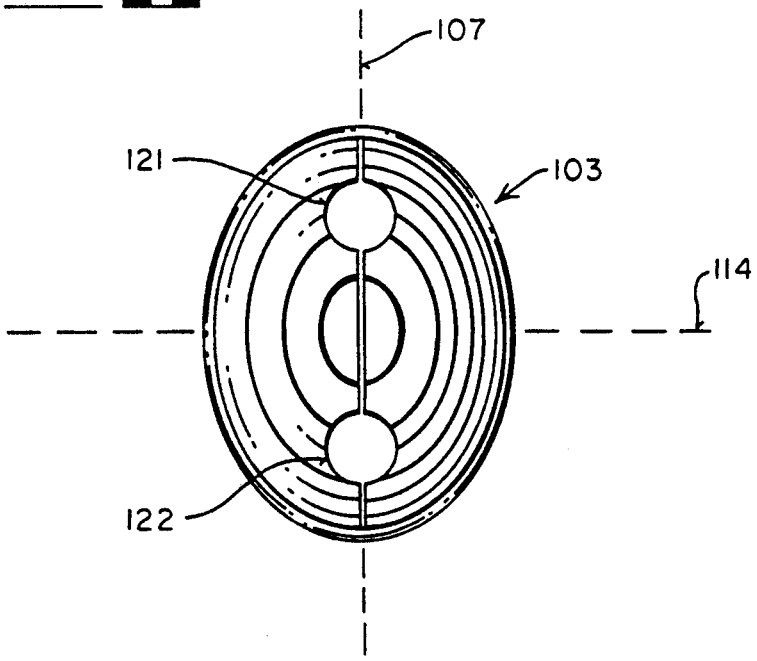
FIG. 8 is bottom view of the personal safety device of the present invention.

The device further comprises two end sections, 102 and 103, located at opposite ends of the midsection along the first axis 105. These end sections 102 and 103 are sometimes referred to herein as sound chambers and it will be seen that in the preferred embodiment, these ends house the speakers of the device of the present invention. The end sections are of relatively identical construction and are illustrated with reference to FIGS. 7 and 8. FIG. 7 is a top view of the device of the present invention while FIG. 8 is a bottom view. The top section 102 is generally oval shaped having a third dimension of approximately 52 millimeters along a third axis 109 and a dimension of approximately 41 millimeters along axis 113. The top section 102 has defined therein sound chamber main holes 117 and 118. The holes 117 and 118 have a radius of approximately 9 millimeters. Looking at FIG. 1, it is seen that the top end further defines sound chamber vents 125. The top end measures approximately 20.5 inches in height (e.g. along dimension 106). As was stated the bottom section is of relatively identical construction having a fourth dimension along axis 107 of approximately 52 millimeters and a dimension along axis 114 of approximately 41 millimeters. The bottom section 103 further defines holes 121 and 122, as well as defining holes 126.

It will be seen that the device is powered by a set of batteries. These batteries are held in a battery chamber within mid-section 104 which is covered with battery cover 134. Battery cover 134 is designed to be relatively difficult to remove without the assistance of some tool, such as a screwdriver blade or a coin. The tool may be inserted in slot 135 in order to remove the cover, for example, to change the batteries. However, it should be difficult if not impossible to remove the batteries without assistance of some type of a tool. This leads to the advantage of preventing easy removal of the batteries (and, thus, disabling of the device) by an attacker.

The device 101 further includes a clip 131 along its mid-section 103 which may be used to attach the device 101 to, for example, a belt worn by the user or to the carrying strap of a purse held by the user.

Still further, the mid-section 103 includes a button 132. The functions of the button 132 include resetting the device 101, testing the device 101, and deactivating the device 101. These functions will be described in greater detail below. The button 132 is recessed into the mid-section 103 to prevent accidental depression of the button 132.

Finally, and perhaps, most importantly, the device 101 defines activation grips 136 and 137 along mid-section 103. The activation grips 136 and 137 are textured to allow easy gripping. Importantly, the grips 136 and 137 are located along substantially the entire length of mid-section 103 and are located on opposing sides of the mid-section 103. The device 101 is naturally held by the user along the mid-section 103 and, regardless of the orientation of the device when so held, the user will have the ability to depress one or both of the grips 136 and 137 to activate the device.

The device 101 is designed such that a predetermined amount of pressure is required to be applied on either grip 136 or 137 to activate the device 101. In the preferred embodiment, approximately fourteen (14) pounds of pressure must be applied to the center of the grip in order to achieve activation. Slightly less pressure may be applied to the outer edges of the grip. It has been found that requiring approximately fourteen pounds of pressure leads to an optimal tradeoff between prevention of false activations and allowing the device to be readily activated. It might also be noted here that the device is activated only after the appropriate amount of pressure is applied to the grips continuously for a preset period of time. In other words, some instantaneous pressure exceeding the fourteen pound threshold would not cause activation of the device. This feature helps prevent false alarms which may otherwise occur when the user, for example, while running with the device in hand, trips slightly and momentarily accidently squeezes the device. Activation of the device will be described in greater detail below with reference to the discussion of microprocessor control of the device.

It is now noted that as one feature of the present invention, the third and fourth dimensions described herein are larger than the second dimension. As can be seen from a review of the figures, this provides for protection of the activation grips 136 and 137 in the event the device is, for example, dropped on a surface.

Further, it is again noted that ends 102 and 103 in the preferred embodiment each house a speaker. The speakers are activated by depressing the activation grips 136 and 137. As another feature of the device of the present invention, the speakers and holes 117, 118, 121 and 122 (which provide for emitting of the sound) are positioned such that the sound when emitted is directed in substantially a first direction (generally along axis 105) by a first of the speakers located in end 102 and the sound when emitted is directed in substantially a second direction, generally opposite (180°) of the first direction, (and, again generally along axis 105). This feature of positioning the speakers to direct sound in generally opposite directions provides for increased area coverage by sound produced by the device of the present invention.

In the preferred embodiment, the housing of the device is made of a polycarbonate material. The acoustic mounts described herein are constructed of an ABS (acrylonitrile butadiene styrene) resin. Of course, numerous other materials may be chosen without departure from the spirit and scope of the present invention. For example, other plastics or resins may be chosen with various cost and performance tradeoffs.

In addition, it is now noted that the device of the present invention measures, in total, along axis 105 approximately 120 millimeters. This dimension has been chosen, first, because it leads to a device size which may be comfortably carried in the typical user's hand. The device, with the described dog bone shape and size, may be securely and naturally held in the user's hand. Secondly, and importantly, the chosen dimension leads to a device of such length, with speakers positioned as has been described, which will make it extremely difficult, if not impossible, to cover both speakers (in an attempt to quiet the device) without using two hands to do so. In the event of an attack, and upon activation of the device, the attacker will then be faced with the choice of either (1) holding the device with both hands in order to attempt to silence it, (2) to leave, or (3) to continue the attack while the device continues to emit sound. As will be discussed in more detail below, the third option will not be attractive to the attacker not only because of the strong possibility of being apprehended, but also because the sound emitted by the device is offensive to the ears at short range. Of course, option (2) is desirable because the threat of attack is then eliminated. Option (1) may also be desirable because the attacker cannot easily continue the attack while so holding the device.

BLOCK DIAGRAM OF COMPONENTS OF THE PERSONAL SAFETY DEVICE

Figure 10:
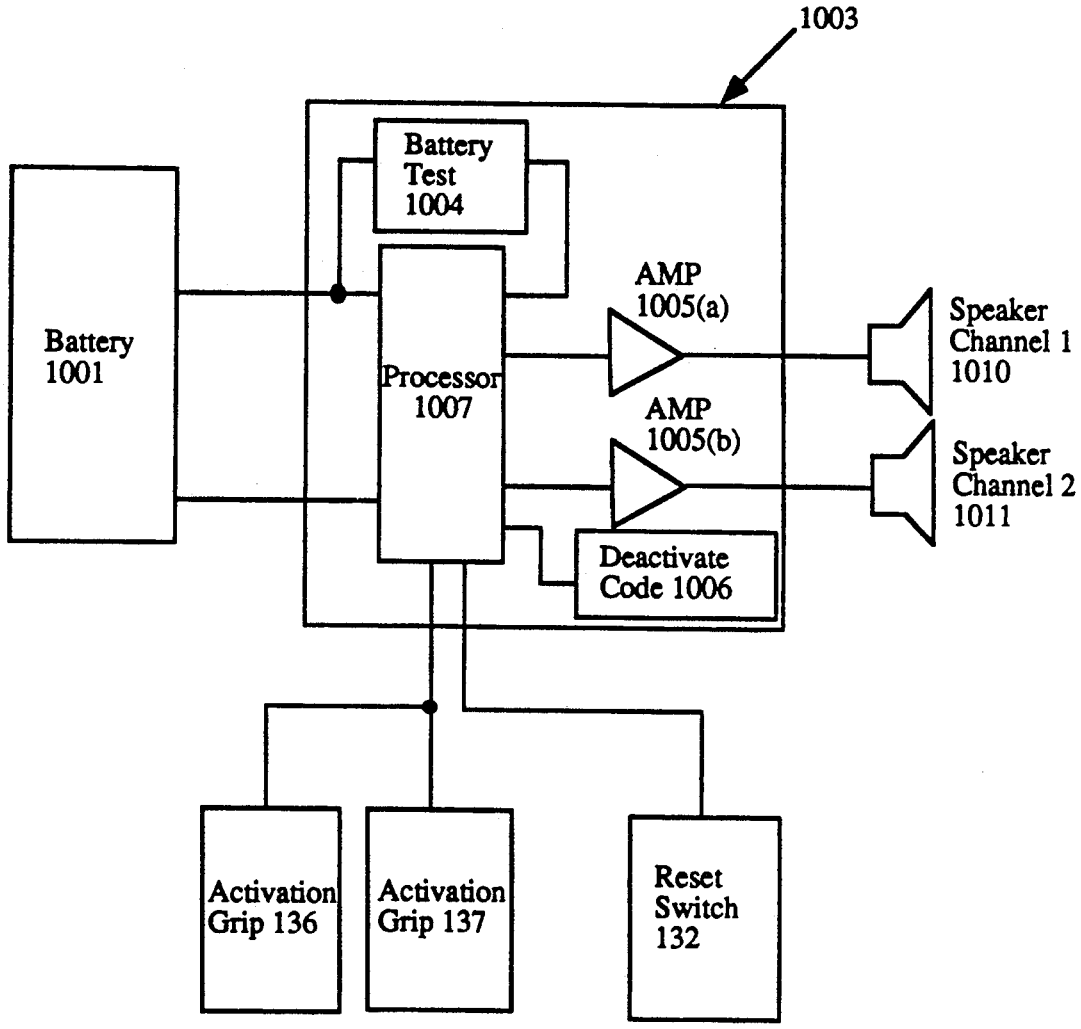
FIG. 10 is a block diagram illustrating certain circuitry of the device.

FIG. 10 illustrates a block diagram of certain components of the device of the present invention. A power source 1001, preferably batteries and most preferably 4 "AAAA" type batteries, is housed in a secure compartment 1003 within mid-section 103. The power source is coupled to various electronic security circuits housed securely within the mid-section 103, including a processing unit 1007, preferably a COP822 microprocessor available from National Semiconductor of Sunnyvale, Calif., and power test circuitry 1004. The electronic circuitry provides for control of activation and deactivation of the device 101, tests the integrity of the power source 1001, generates the electronic signals required to create sounds, and amplifies those signals to drive loudspeaker 1010 (housed in end 102) and loudspeaker 1011 (housed in end 103).

The processor 1007, as has been stated, is coupled to receive power from power source 1001. The processor is further coupled to receive a signal from power test circuitry 1004 indicating whether the power level of the power source 1001 is either low or high. Further, the processor 1007 is coupled with a momentary switch which in turn is coupled with grips 136 and 137. The momentary switch provides electrical signals to the processor 1007 indicating the one or both of the grips 136 and 137 have been depressed. Still further, the processor 1007 is coupled to a second momentary switch which in turn is coupled with the reset button 132. The second momentary switch provides an electrical signal to processor 1007 each time button 132 is depressed.

The device further comprises a memory device 1006 which is programmed at time of manufacture with a disable code which consists of information detailing a sequence of inputs which must be received from button 132 and activation grips 136 and 137 in order to deactivate the device 101 once the device has been activated. In the preferred embodiment, a set of jumpers are utilized as the memory device as will be described in greater detail below. However, in alternative embodiments, other forms of memory devices may be utilized such as a ROM or an EEPROM.

The memory device 1006 is coupled with the processor 1007 and it will be seen that during operation of the device, the information in the memory device 1006 is read by the processor 1007 to allow comparison of this information with input patterns of inputs received from button 132 and activation grips 136 and 137.

Of course, it is recognized that one of ordinary skill in the art could develop an alternative embodiment in which these sequences were programmable and reprogrammable by the user of the device. Further, it is thought that one of ordinary skill in the art could develop an alternative embodiment in which other input means are utilized to input a code which acts to deactivate the device.

Finally, the processor 1001 is coupled with speakers 1010 and 1011 through amplifiers 1005.

ELECTRONIC CIRCUITRY OF THE PREFERRED EMBODIMENT

Figure 11:
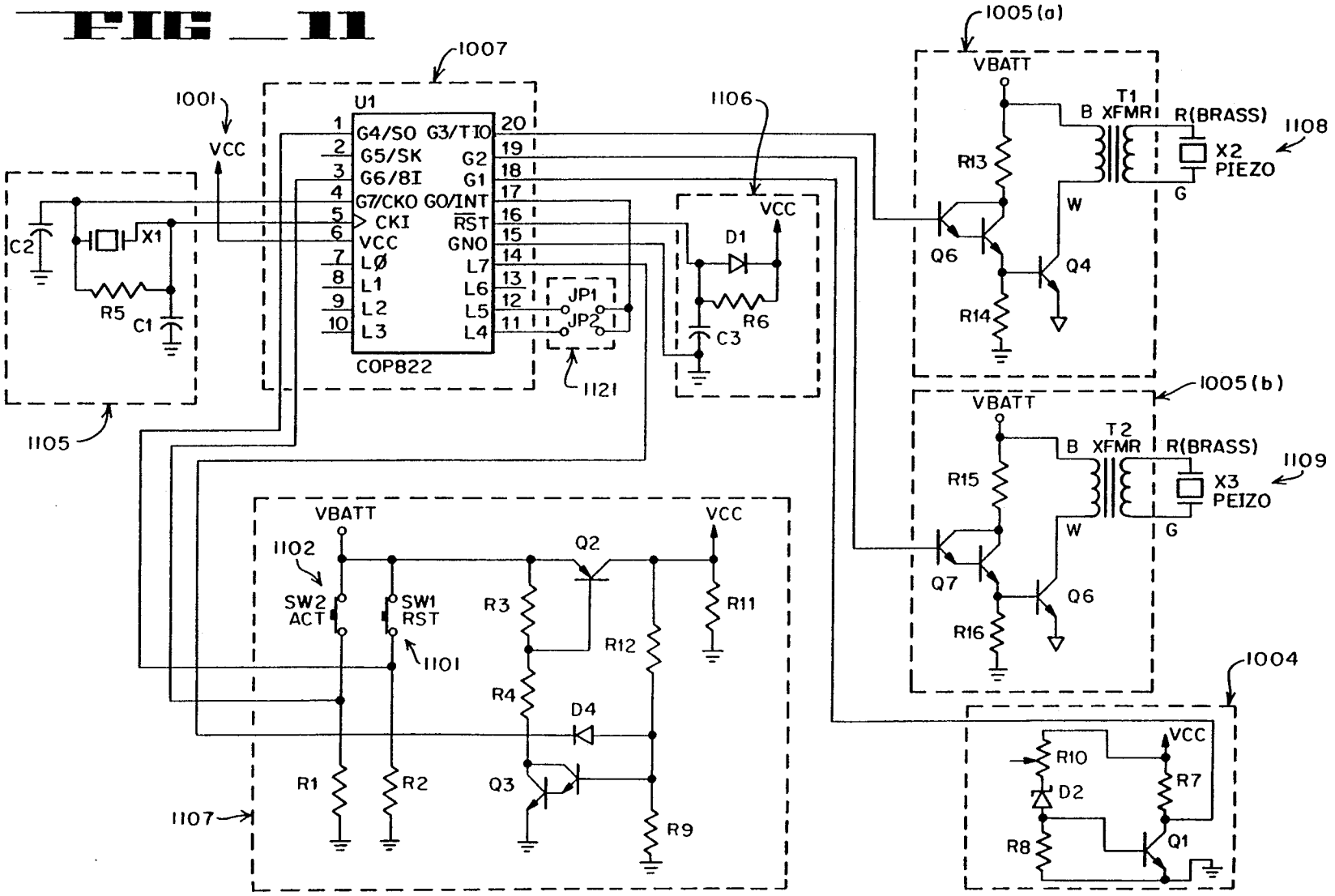
FIG. 11 is a circuit diagram illustrating certain electrical circuitry of the device of the present invention.

The electronic circuitry of the device of the preferred embodiment is better illustrated with reference to FIG. 11.

Power Saving Circuitry 1107

As can be seen, the processor 1007 is coupled with a source of power on its $V_{cc}$ input. In the preferred embodiment, the source of power is circuitry 1107 which is coupled to receive $V_{BATT}$ and to provide $V_{cc}$ upon activation of the device 101 through depressing either the button 132 and thereby activating switch 1101 or depressing either of grips 136 or 137 and thereby activating switch 1102. This allows power to be conserved during periods of time when the device is not being used.

When either switch 1101 or 1102 is pressed, current is supplied to the base of transistor Q2 which turns on and presents a voltage at $V_{cc}$. This voltage enables current to flow through a resistive divider (R12 and R9), providing a base current to darlington transistor Q3. This base current turns on transistor Q3 and once Q3 is turned on, current is continuously supplied to the base of Q2, keeping Q2 on even after the pressed switch 1101 or 1102 is released.

Once power is supplied to processor 1007 as described above, the processor 1007 is reset via the reset circuit 1106 and the processor initiates the rest of the described circuit in accordance with its programming. The programming of the processor 1007 is described in greater detail below with reference to FIG. 12.

The device may power itself off by the processor 1007 bringing low its L7 port. This low signal causes the darlington transistor Q3 of the power saving circuitry 1107 to be held low, removing its base drive. With its base drive removed, it can no longer supply current to the base of Q2, so Q2 is shut off. This removes power at point $V_{cc}$ and the system is shut off.

Clocking Circuitry 1105 and Reset Circuitry 1106

The processor 1007 is further coupled with oscillator circuitry 1105 for clocking the processor 1007 and is further coupled with reset circuitry 1106 for resetting of the processor 1007. Both the oscillator circuitry 1105 and the reset circuitry 1106 are well specified by the manufacturer and, therefore, no further description of this circuitry is understood to be necessary.

Battery Test Circuitry 1004

The battery test circuitry 1004 is now described. The battery test circuitry is coupled to provide a signal on the G1 (pin 18) input of the processor 1007 which indicates the power level of the battery as either high or low. As will be described below, the signal received on its G1 pin is used by the processor 1007 to provide with user with an indication of whether the batteries should be changed. This feature is, of course, invaluable, in that the device 101 must be, above all, dependable.

$V_{cc}$ power is applied through resistor R10 to zener diode D2, and if of at least the required minimum power level, current will flow through zener diode D2 and to resistor R8 and will also supply the base of transistor Q1 with current. Transistor Q1 is caused to turn on by application of this current. If Q1 is on, current flows through resistor R7 causing a voltage drop across it which in turn causes the connection to G1 of processor 1007 to be low. If the power received on $V_{cc}$ is below the required minimum, zener diode D2 fails to conduct and, therefore, no current flows through R7. In this case, the connection to G1 of processor 1007 is shown as high.

Amplifier Output Circuitry 1005(*a*) and 1005(*b*)

The circuitry of amplifiers 1005(*a*) and 1005(*b*) is identical and, therefore, will only be described with reference to amplifier 1005(*a*). The amplifier comprises darlington transistor Q5, transistor Q4, resistors R13 and R14, and transformer T1. A sound signal, described below as a digital signal of varying frequency, is applied to Q5 via pin G3 of processor 1007. When G3 is high, this signal acts to turn on Q5 and allow a current to flow through its collector via R13 which, in conjunction with R14, limits the current to a level which will not harm Q5. This current acts to turn on Q4 which allows a large current to flow from $V_{BATT}$ through the primary of transformer T1. When G3 is low, this signal "turns off" Q5 which in turn turns off Q4, ceasing current flow through the primary of T1. The result is a large alternating current on the primary of T1 which appears as a large alternating voltage on the secondary of T1. This alternating voltage of the secondary of T1 is applied to piezoelectric element 1008 of speaker 1010.

As stated above, circuit 1005(*b*) works in a similar manner to apply a voltage to piezoelectric element 1109.

Deactivate Codes 1121

In the preferred embodiment, the deactivate codes for the system are coded in two jumpers JP1 and JP2, allowing for four combinations of codes. These jumpers are coupled with the L4 and L5 inputs of processor 1007 and are read by processor 1007 as will be described.

Of course, in an alternative embodiment, the codes may be stored in another type of a memory device such as a ROM or an EEPROM. However, such an alternative while allowing certain advantages such as an increased number of possible codes, also will likely involve increased cost.

OPERATION OF THE DEVICE OF THE PREFERRED EMBODIMENT

Figure 12:
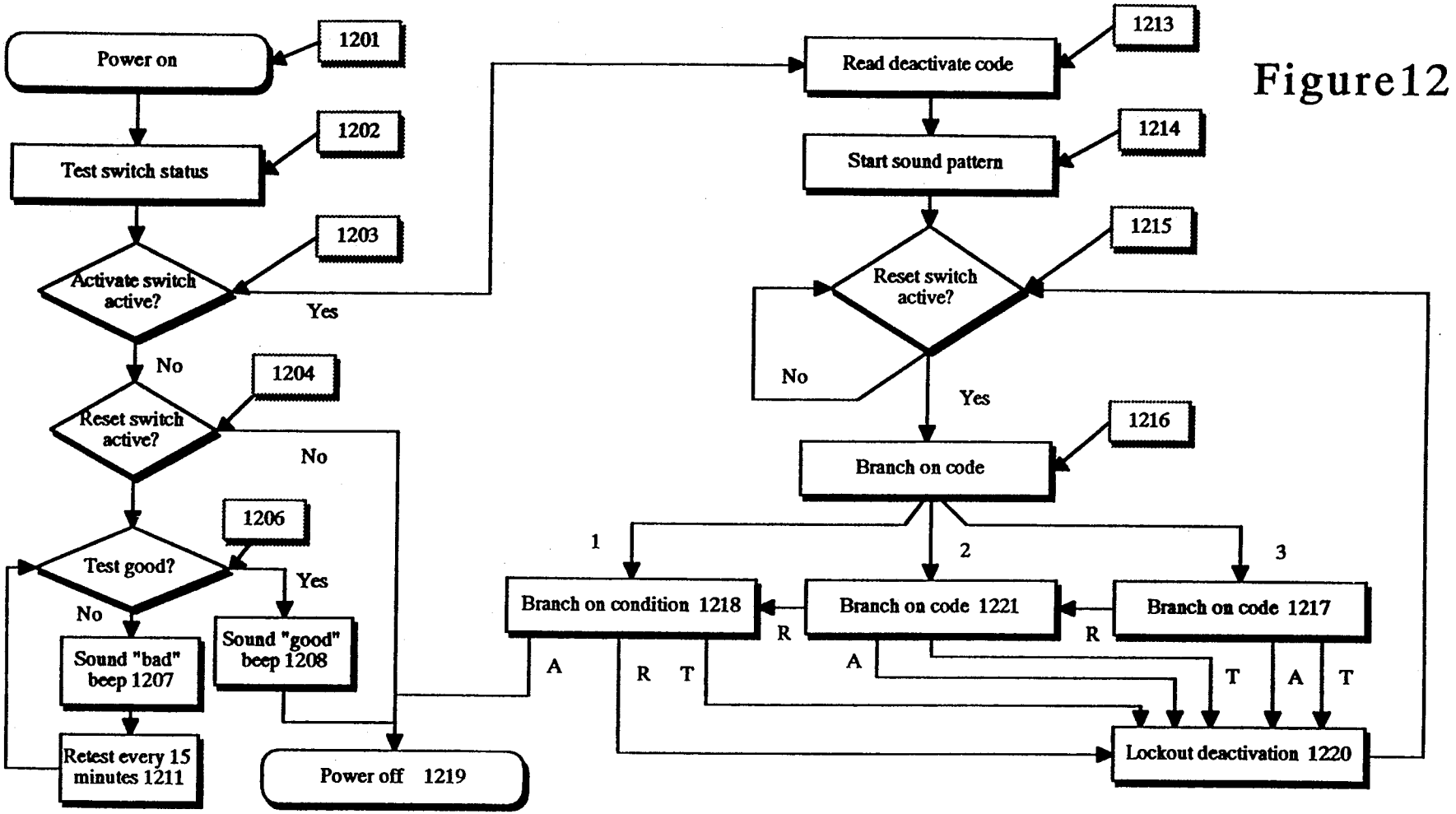
FIG. 12 is a flow diagram illustrating certain methods implemented by an operating program executing on a processor utilized by the device of the present invention.

It is now worthwhile to discuss the operation of the device of the preferred embodiment in greater detail and this is done with reference to FIG. 12 which is a flow diagram illustrating the functional flow of the operating program of the processor 1007.

Power On

Initially, the processor is powered on, block 1201, in the manner that has been previously described. That is, the processor 1007 is powered by either depressing button 132 or one of the activation grips 136 and 137. At the time it is powered up, the processor 1007 first determines the status of the switch 1101 and 1102, block 1202. If switch 1101 is not active, block 1203, and if switch 1102 is not active, block 1204, the device is powered off.

Battery Test

Otherwise, if switch 1102 is active, block 1204, the battery test input (G1) is tested to determine the state of the battery. If the battery tests goods, a good battery "beep" is sounded, block 1208, and the device powers itself off, block 1219. If the battery does not test good, a bad battery "beep" is sounded, block 1207, and the device retests the battery every fifteen minutes, block 1211, until the battery either tests good or the batteries are removed from the device or battery power goes so low that it cannot power the processor.

Activate Device

In the event the activate switch 1101 is found to be depressed, block 1203, the processor monitors the activate pin (pin 14) for a predetermined period of time to determine if the grips 136 and 137 remain squeezed continuously for this entire predetermined period of time. In the preferred embodiment, the predetermined period is 200 milliseconds. This feature of monitoring the status of the grips for a period of time is an important aspect of the present invention for prevention of false activations of the device.

After the processor determines the grips have been squeezed for the full, continuous period, the processor then reads the deactivate code inputs on its L4 and L5 inputs, block 1213. After reading and storing the deactivate code, the processor causes the appropriate alarm signals to appear at its output pins, block 1214, (the alarm signals of the preferred embodiment will be discussed in greater detail below). This will, of course, cause the alarm to sound. The processor continues to provide the alarm signals at its outputs until the alarm is deactivated as described below.

Monitor for Entry of the Deactivate Code

In order to deactivate the device of the preferred embodiment, the user first depresses button 132 (which is coupled with switch 1102) to initiate the deactivate cycle. Therefore, after being activated, the processor monitors switch 1102, block 1215. If and when switch 1102 is depressed, branch on code 1216 is executed. The particular branch taken is dictated by the setting of the deactivate code 1006. As has been discussed, the deactivate code is preferrably set with jumbers 1121. In the preferred embodiment, if both jumpers are closed, the code evaluates to a 1; if one jumper is open and the other jumper is close, the code evaluates to a 2; and if both jumpers are open, the code evaluates to a 3. Thus, as can be seen, if the deactivate code is a 3, block 1217 is executed. Block 1217 is a branch on condition block in which the code is caused to branch to deactivation lockout code 1220 if either the activation switch is depressed (i.e., the grips 136 or 137 are squeezed) or if a timeout occurs. A timeout occurs if neither the activation switch or reset switch is depressed for a period of 3 seconds. The deactivation lockout code 1220 causes further attempts to deactivate the device to be locked out for a period of 5 seconds. After the lockout period, a branch is made to the block of code for monitoring the reset switch, block 1215.

Alternatively, if the reset switch is again depressed, a branch is made to branch on condition code 1221. Branch on condition code 1221 is also executed if the deactivation code set by the jumpers is set to 2.

Branch on condition code 1221 causes a branch to lockout code 1220 when either the grips 136 or 137 are squeezed or upon a timeout. Alternatively, if the reset switch is again depressed, a branch is made to branch on condition code 1218. If the deactivation code is set to a 1, branch on condition code 1218 is also branched to from branch on code 1216. In either event, branch on condition code 1218 causes the code to branch to lockout code 1220 when either the reset button is depressed or upon a timeout. Alternatively, if the grips 136 or 137 are squeezed, the device is deactivated and powered off, block 1219.

Thus, it can be seen that the deactivation code being set to 1 causes the deactivation sequence to require the reset button to be depressed one time, followed by squeezing the activation grips 136 or 137. If the deactivation code is set to 2, the reset button must be depressed two times, followed by squeezing the grips 136 or 137. If the deactivation code is set to 3, the reset button must be depressed three times, again followed by squeezing the grips 136 or 137.

ACOUSTIC DESIGN

Two aspects of the acoustic design of the present invention are especially worth noting. First, it is worthwhile to describe the construction of the speakers themselves, and then it is worthwhile to describe the signals received by each of the two speakers from processor 1007 and the sound generated as a result of the speaker design and received signals.

Speaker Construction

Figure 13:
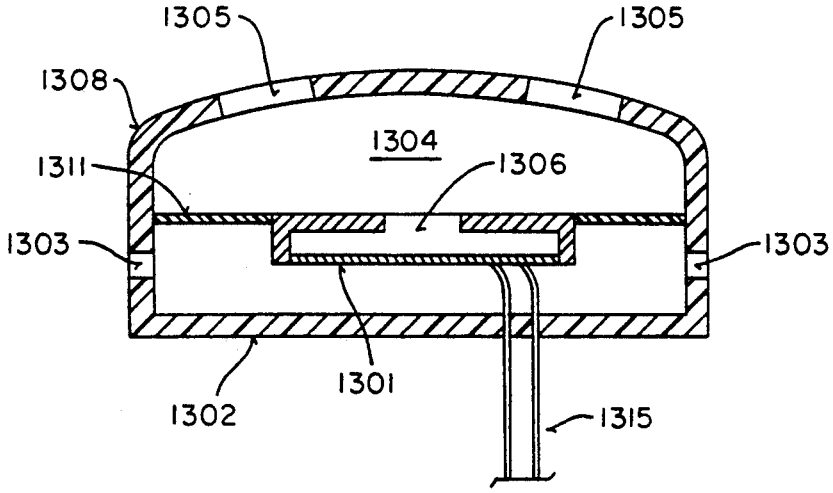
FIG. 13 is diagram illustrating construction of speakers as may be utilized by the present invention.

Referring now to FIG. 13, certain features of the acoustic structure of the device of the present invention will be described in greater detail. As has been described, the acoustics of FIG. 13 are housed in each end 102 and 103 of the device. The acoustics comprise a conventional 4 kHz piezoelectric bender 1301 which comprises a slice of piezoelectric crystal mounted on a thin metal disc. The disc is preferably constructed of brass; however, alternative materials such as stainless steel or a hard plastic may be utilized. The bender 1301 is coupled through electric leads 1315 with an output of processor 1007 as was illustrated by FIG. 11 (the acoustics mounted in end 102 being coupled, through one of the amplifiers 1005(*a*) or 1005(*b*), with one of leads 19 or 20 of processor 1007, while the acoustics of the other end 103 are coupled with the other of leads 19 or 20, again through one of the amplifiers 1005(*a*) or 1005(*b*)).

Now, it is important to note that bender 1301 vibrates in response to electrical signals received from processor 1007 and bender 1301's natural resonant free-air frequency of 4 kHz means that input signals on line 1315 near 4 kHz will produce maximum vibration. However, it is desired by the design of the system of the preferred embodiment to produce loud output for input signals on line 1315 at 3.3 kHz. It might be noted that although alternative frequencies may be utilized in certain alternative embodiments, it has been found that use of the preferred 3.3 kHz resonent frequency leads to a preferred sound.

Of course, 3.3 kHz crystals could be substituted for the 4 kHz crystals of the preferred embodiment of the present invention. Unfortunately, 3.3 kHz crystals are not as commonly available as 4 kHz crystals. Therefore, the bender 1301 is mounted within helmholtz chamber 1306.

Helmholtz chamber 1306 is tuned to 3.33 kHz and is used to tune the resonant frequency of bender 1301 by providing a resonant system at 3.33 kHz which is excited by the broadband sound radiation from the bender. The port of helmholtz chamber 1306 is also tuned to 3.3 kHz to provide maximum transfer of sound energy from the piezoelectric transducer 1301 to the free air environment. Design of such a helmholtz chamber is well within the capabilities of a person of ordinary skill in the art and, in fact, such chambers are described in Piezo-Alarms, Catalog No. P-01-A available from Murata Erie North America of Smyrna, Ga.

Chamber 1306 is suspended on plastic web 1311 within chamber 1302. Plastic web 1311 allows flow of air around and within chamber 1302. The chamber 1302 comprises a rigid diaphragm and defines ports 1303 and 1305. Ports 1303 correspond to ports 125 and 126 of FIG. 1 while ports 1305 correspond to ports 117, 118, 121 and 122 of FIGS. 7 and 8.

The ports are positioned such that ports 1305 allow for generated sounds to pass to the surrounding environment at high efficiency generally away from the device 101 and generally in the direction of axis 105 while ports 1303 allow generated sounds to pass to the surrounding environment, again at a high efficiency, generally in the direction of axis 105 and back along the device 101 toward the other speaker. In this way, the sounds of the two speakers are allowed to combine to provide a net higher sound output.

The chamber further defines a volume 1304 which acts as an acoustic load for sound energy received from chamber 1306. This is important because when bender 1301 is driven at very high energy levels, it tends to develop destructive frequency standing waves which could damage bender 1301 and which can reduce acoustic efficiency by shifting power to non-audible frequencies. The destructive frequency waves are generally both higher and lower than the resonent frequency of the transducer. Therefore, the additional acoustic load provided by air in volume 1304 acts to dampen the destructive frequencies preventing the bender 1301 from oscillating destructively at the undesirable frequencies and allowing the substantially greater power levels to be applied to the device than would otherwise be achievable. Of course, the increased power levels allow for louder sound to be produced which, in the device of the preferred embodiment, is a very desirable result.

Signals Received by the Speakers and Resulting Sounds

It is desirable in the device of the present invention to produce a sound which is relatively offensive to the human ear when heard by a listener who is within a short distance of the device. This goal is of course motivated by the fact that the persons within a short distance of the device when it is activated are expected to be the user of the device and an attacker or potential attacker. Of course, the sound may be offensive to both; however, it is hoped that the sound will be offensive enough to motivate the attacker to leave at which point the user may then proceed to deactivate the device.

It is equally desirable in the device of the present invention to produce a sound which may tend to attract persons, at greater distances from the device, to come to the source of the sound.

To these ends, significant work has been performed in the development of the device of the present invention to develop a device capable of producing such a sound. The sound is produced both as a result of the construction of the speaker which has been described herein and as a result of control of those speakers through signals generated by the microprocessor 1007. The control of the speakers will now be discussed in greater detail with reference to FIG. 14.

Figure 14:
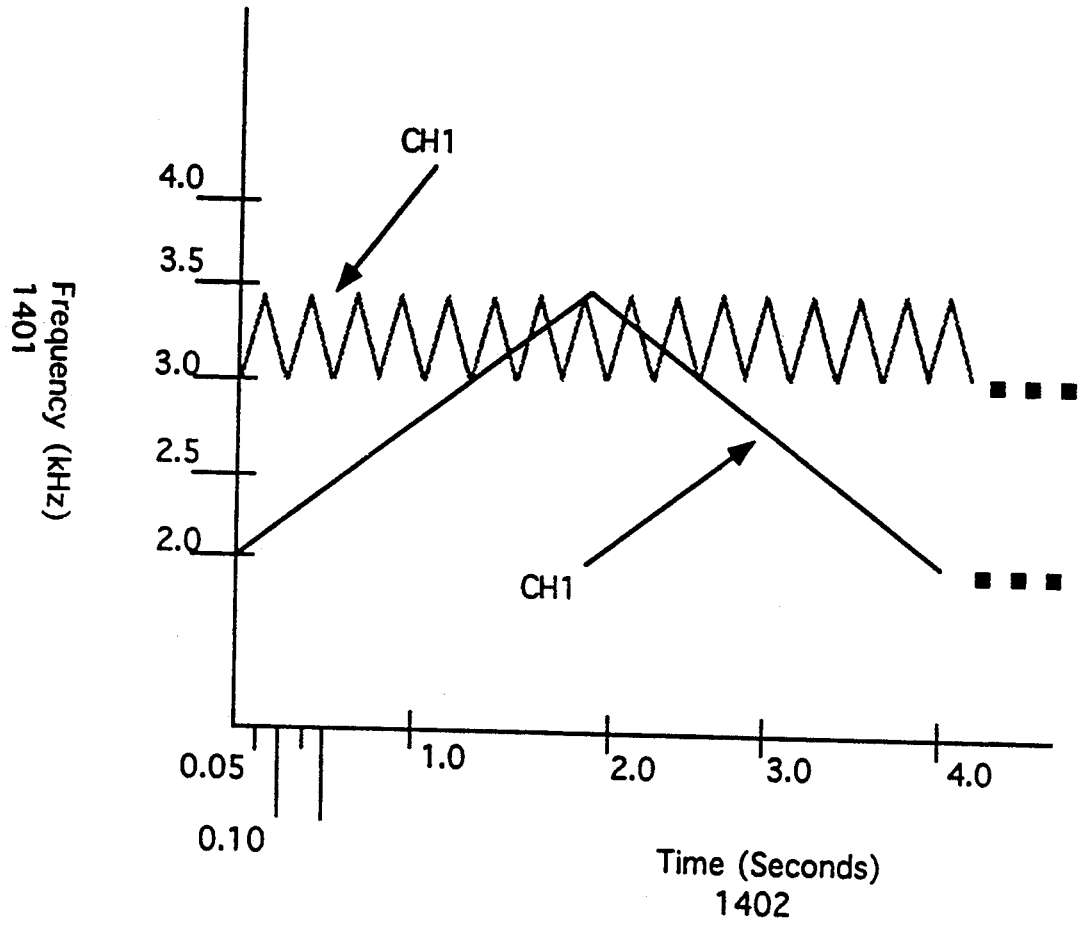
FIG. 14 is a diagram illustrating sounds generated by the two separate speakers or channels of the device of the present invention.

FIG. 14 illustrates, in the form of a graph, two sound patterns which have been labeled CH1 and CH2; the sound pattern CH1 corresponds to the sound pattern generated by one of the speakers (the "first speaker) housed in one end 102 or 103 of the device 101 while the sound pattern CH2 corresponds to the sound pattern generated by the other speaker (the "second speaker) housed in the other end 102 or 103. Along the vertical axis 1401, the frequency of the sound pattern is charted and along the horizontal axis 1402, passage of time is illustrated.

Processor 1007 controls the first speaker to begin emitting at 3.0 kHz and to sweep to 3.5 kHz in 0.05 seconds and then to sweep back from 3.5 kHz to 3.0 kHz in 0.05 seconds, creating a wave with a period of 0.10 seconds. This pattern is repeated until deactivation.

Processor 1007 controls the second speaker to begin emitting at 2.0 kHz and to sweep to 3.5 kHz over a substantially longer period, specifically over 2.0 seconds. During the next 2.0 seconds the signal is caused to sweep back from 3.5 kHz to 2.0 kHz, creating a wave with a period of 4.0 seconds. This pattern is also repeated until deactivation.

It is important to now consider the effect of these signals on the listener. The two speakers create sound sources which, at any moment, are close to pure single frequency sinusoids due to the nature of the piezoelectric crystal 1301. However, the detector of these sound waves (e.g., the human ear) experiences two sounds impinging simultaneously. In fact, the detector perceives at least four sources because, from algebra, it is known that the sum of the two sinusoidal sources, sin(channel 1)+sin(channel 2), is equivalent to the sum of two other signals—sin(channel 1+channel 2) and sin(channel 1−channel 2). Therefore, the detector perceives four sound sources which may be represented as sin(channel 1), sin(channel 2), sin(channel 1+channel 2) and sin(channel 1−channel 2). Any harmonic distortion present in the signals will tend to generate the same effect in each of the harmonics.

The two frequencies, from channel 1 and channel 2, are changing in time independent of each other, both in phase and in frequency. This results in an extremely complex and distinctive sound.

Now, due to the nature of absorption of sound waves in the air, it has been found that the higher frequency harmonies and the pure tones generated by the speakers themselves will tend to have a greater range than other tones. Therefore, and importantly, the sound experienced by the listener is different depending on the distance of the listener from the device 101. At relatively long distances, the pure tones produced by the device of the present invention are experienced as relatively independent, but distinctive signals. At relatively closer distances, the full range of harmonics described above are experienced as a confusing cacophony.

It might be noted that the present invention utilizes both a first and a second speaker to provide the described sound output. In an alternative embodiment, a single speaker may be provided and the single speaker may be coupled with both the first and second outputs of the processor 1007. Such a design would lead to a device which would take advantage of at least some of the aspects of the present invention and a device of this design is thought to be within the scope of the present invention.

OPERATION OF THE DEVICE OF THE PRESENT INVENTION

The operation of the device 101 has already been described in significant detail, especially from a mechanical, electrical and sound generation standpoint. However, it is now appropriate to briefly turn to operation of the device from the standpoint of a user of the device in order to describe certain advantages of such operation.

For purposes of this discussion, grips 136 will be referred to as the activation grips and button 132 will be referred to as a reset button although the button serves additional functions beyond acting under certain circumstances to reset the device 101.

Figure 15:
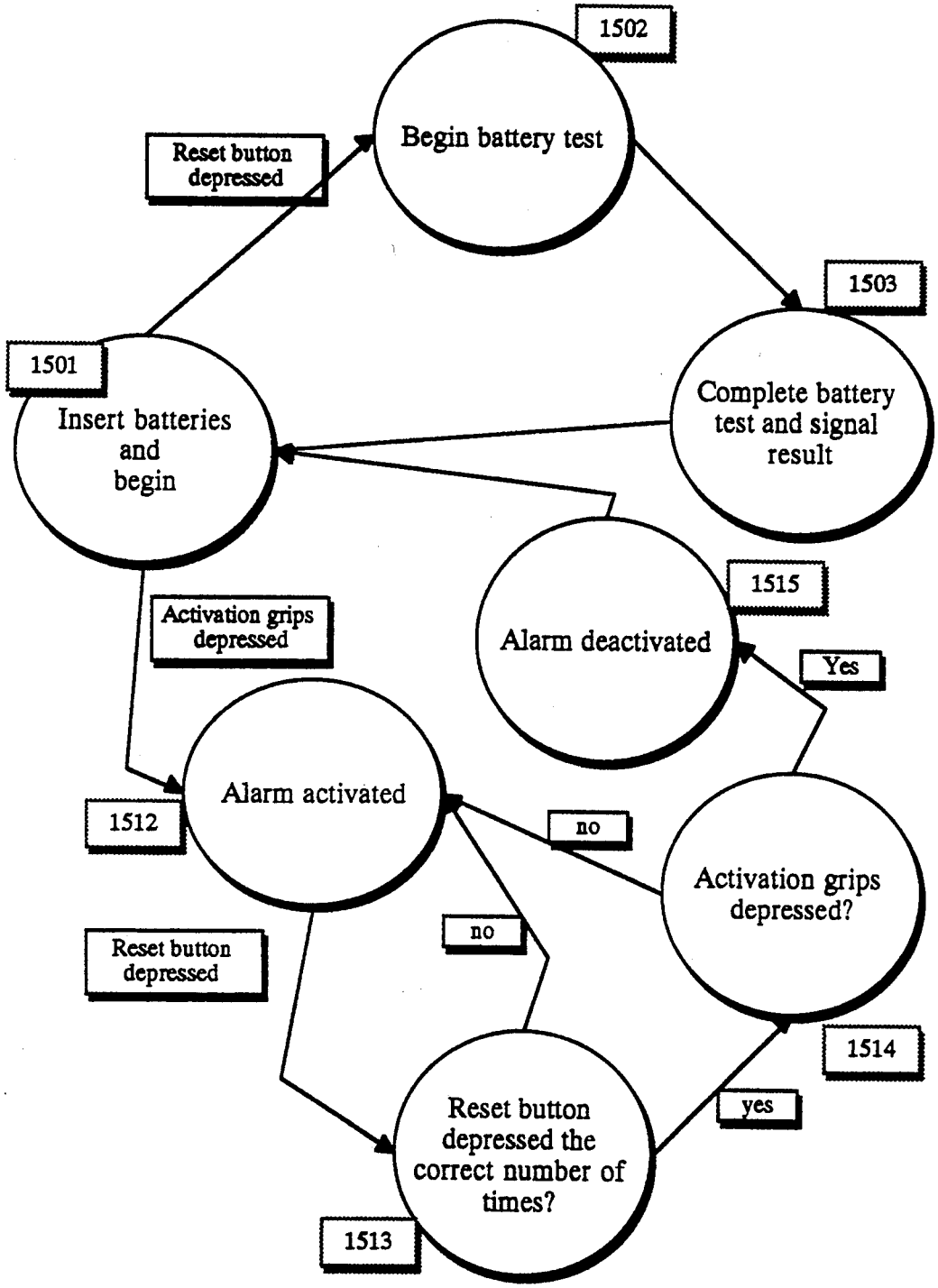
FIG. 15 is a state diagram useful for illustrating the steps involved in using the device of the present invention.

FIG. 15 is a state diagram which illustrates certain states of use of the device and this figure will now be discussed in greater detail. Initially, batteries are inserted, 1501. The functioning of the device will then depend on the actions of the user (e.g., which buttons, if any are pushed).

The user may depress the reset button 132 in order to cause the device to perform a battery test, 1502. After completing the battery test, the device signals the result, 1503, as has been described. The device then returns to a state of waiting for the user to depress a button, either the reset button 132 or the activation grips 136.

Now, the user may carry the device about during everyday activities. The device 191, as has been described, may be easily carried in the user's hand, may be carried by a lanyard, coupled with a belt by using the belt clip 131, carried in a purse, or it may be otherwise transported. In any event, it can now be appreciated that the device 101 is easily and quickly gripped in a manner for activating the device. When it is desired to activate the device 101, the user simply grips the device with slight but sufficient pressure almost anywhere along the body of the device 101. The device 101 is activating by such gripping and the processor carries out its sequence (which has been already described) in order to cause the device 101 to begin generating sound (loud sound!), 1512.

The device will stay activated as long as sufficient power remains in the batteries until it is explicitly deactivated by the user entering a code. In the preferred embodiment, this code is preset at time of manufacture to require the user to depress the reset button 132 a predetermined number of times, 1513, followed by depressing the activation grips 136 again, 1514. The alarm is, thus, deactivated, 1515, and returns to a state of waiting for a button to again be depressed.

ALTERNATIVE EMBODIMENTS

There are, of course, any number of alternatives or changes in the design of the device 101 which may be readily apparent to one of ordinary skill in the art. Such alternatives may not be employed in the device of the preferred embodiment for any number of reasons, such as cost and performance considerations, size constraints, availability of materials, arbitrary design decisions, and the like. A number of these alternatives have been mentioned above. However, it is felt that it may be worthwhile to mention several other alternatives here for purposes of examples of such alternative embodiments. This is, of course, done without limitation to other embodiments which may be equally obvious to one of ordinary skill, but are not mentioned here because of time and space constraints.

As one alternative, the amplification circuitry could be readily altered to use a single, multiplexed, amplification device which is switched between the two channels. A second alternative may allow use of sound signals which are produced through use of analog voltage controlled oscillators, operating either independently or being controlled by the processor 1007. Of course, many alternative processors could be used. Also, the device itself could also be of various shapes, sizes and materials.

Thus, the invention is intended to be limited only by the claims which are meant to cover such obvious alternatives and deviations from the preferred design.

Thus, what has been described is a personal safety device which provides for both deterrence of attackers and for attracting third-parties to come to the assistance of the individual using the device.

What is claimed is:

1. A personal safety device comprising:

(a) a housing for housing components of said personal safety device;

(b) sound generation means for producing an audible alarm, said sound generation means housed within said housing;

(c) activation means for allowing a user of said personal safety device to cause activation of said sound generation means, said activation means housed within said housing;

(d) a multiple-bit microprocessor for controlling functions of said personal safety device, said microprocessor housed within said housing.

2. The personal safety device as recited in claim 1 wherein said sound generation means comprises at least one speaker.

3. The personal safety device as recited in claim 2 wherein said sound generation means comprises a first speaker and a second speaker.

4. The personal safety device of claim 3 wherein said microprocessor is coupled with said first speaker through a first amplifier and a said microprocessor is coupled with said second speaker through a second amplifier.

5. The personal safety device of claim 4 wherein said microprocessor provides a first digital signal to said first amplifier, said first amplifier supplying a first analog signal to said first speaker responsive to receiving said first digital signal and wherein said microprocessor provides a second digital signal to said second amplifier, said second amplifier supplying a second analog signal to said second speaker responsive to receiving said second digital signal.

6. The personal safety device of claim 5 wherein said first analog signal has a sinusoidal wave component sin(a) and said second analog signal has a sinusoidal wave component sin(b).

7. The personal safety device of claim 6 wherein the frequency of said sinusoidal wave component sin(a) oscillates between F1 and F2 with a period P1 and the frequency of said sinusoidal wave component sin(b) oscillates between F3 and F4 with a period P2.

8. The personal safety device of claim 6 wherein F1 is 3.0 kHz, F2 is 3.5 kHz, F3 is 2.0 kHz, F4 is 3.5 kHz, P1 is 0.10 seconds and P2 is 4 seconds.

9. The personal safety device of claim 2 wherein said microprocessor is coupled to provide electrical signals to said speaker.

10. The personal safety device of claim 2 wherein said microprocessor is coupled with said speaker through an amplifier, said microprocessor supplying a digital signal to said amplifier, said amplifier supplying an analog signal to said speaker.

11. The personal safety device as recited in claim 1 wherein said activation means comprises a momentary switch depressible when squeezing said housing, said momentary switch coupled to provide a first electrical signal to said microprocessor responsive to said momentary switch being depressed.

12. The personal safety device of claim 1 further comprising deactivation means coupled with said microprocessor for deactivating said personal safety device.

13. The personal safety device of claim 12 wherein said deactivation means comprises at least one switch which may be alternatively opened and closed in a preset pattern wherein said microprocessor deactivates said sound generation means responsive to said preset pattern being applied to said switch.

14. The personal safety device of claim 13 wherein a representation of said preset pattern is stored in a storage means, said storage means coupled with and accessible to said microprocessor such that said microprocessor can compare patterns input with said switch with said stored representation of said preset pattern.

15. The personal safety device of claim 1 wherein said sound generation means is powered by a stored energy supply, said device further comprising a test circuit for testing the power level of said stored energy supply, said test circuit coupled with said stored energy supply and further coupled with said microprocessor for supplying said microprocessor with a signal representative of the power level of said stored energy supply.

16. A personal safety device for generating noise responsive to receiving a stimuli, said personal safety device comprising:

(a) a first sound source for generating noise into an environment, said first sound source producing said noise responsive to receiving signals from a signal source; and (b) said signal source comprising at least a multiple-bit microprocessor for producing a first digital signal representative of a sound wave, said multiple-bit microprocessor further for controlling other functions of said personal safety device.

17. The personal safety device as recited by claim 16 wherein said signal source further comprises an amplifier for amplifying said first digital signal received from said microprocessor and for converting said first digital signal to a first analog signal for presentation to said first sound source.

18. The personal safety device as recited by claim 16 further comprising a second source coupled with said signal source.

19. The personal safety device as recited by claim 18 wherein said signal source further comprises a first amplifier for amplifying said first digital signal received from said microprocessor and for converting said first digital signal to a first analog signal for presentation to said first sound source and wherein said signal source still further comprises a second amplifier for amplifying a second digital signal received from said microprocessor and for converting said second digital signal to a second analog signal for presentation to said second sound source.

20. The personal safety apparatus of claim 19 wherein said first analog signal has a sinusoidal component sin(a) and said second analog signal has a sinusoidal component sin(b).

21. The personal safety apparatus of claim 20 wherein said sinusoidal component sin(a) has oscillates from a frequency F1 to a frequency F2 with a period P1 and said sinusoidal component sin(b) oscillates from a frequency F3 to a frequency F4 with a period P2.

22. The personal safety device of claim 21 wherein F1 is 3.0 kHz, F2 is 3.5 kHz, F3 is 2.0 kHz, F4 is 3.5 kHz, P1 is 0.10 seconds and P2 is 4 seconds.

23. A personal safety device comprising:

(a) an activation switch for activating said device;

(b) deactivation means for deactivating said device, said deactivation means allowing entry of a predetermined sequence of signals to said device; and (c) control means for controlling said device coupled with said deactivation means, said control means including logic to determine if said predetermined sequence of signals has been entered using said deactivation means.

24. The personal saftey device as recited in claim 23 wherein said control means comprises a microprocessor and storage means coupled with said microprocessor for storing data representative of said predetermined sequence.

25. A personal safety device comprising:

(a) a housing;

(b) an activation switch for activating said device, said activation switch accessible from outside of said housing;

(c) a deactivation means for deactivating said device, said deactivation means accessible from outside of said housing;

(d) a microprocessor housed within said housing and coupled with said activation switch and said deactivation means, said deactivation means allowing entry of a predetermined sequence of signals to said microprocessor, and (e) storage means for storing data representative of said predetermined sequence of signals, said storage means coupled with said microprocessor.

26. The personal safety device as recited by claim 25 wherein said housing is a dog bone shaped housing and said activation switch comprises a switch depressible upon gripping a center portion of said housing.

27. The personal safety device as recited by claim 26 wherein said deactivation means comprises a second switch on the outside of said housing used in combination with said activation switch to enter said predetermined sequence of signals.

28. A personal safety alarm comprising:

(a) a sound source for providing a sound waves, said sound source comprising a multi-bit microprocessor;

(b) a stored power source for providing power to said sound source;

(c) activation means coupled between said sound source and said stored power source for providing for activation of said sound source by allowing power to reach said sound source; and (d) detection means for detecting the power level of said stored power source, said detection means coupled with said stored power source.

29. The personal safety alarm as recited by claim 28 wherein said detection means is further coupled to provide a signal to said microprocessor, said signal indicative of the power level of said stored power source.

30. The personal safety alarm as recited by claim 29 wherein said signal indicates is the power level of said stored power source is low or high.

31. The personal safety alarm as recited by claim 29 wherein said detection means comprises a transistor having its base coupled with said power source, having its collector coupled with a ground and having its emitter coupled to an input of said microprocessor.

32. The personal safety alarm as recited in claim 28 wherein said stored power source comprises a battery.

33. The personal safety alarm as recited by claim 32 wherein said sound source comprises a speaker.

34. A method for operating a personal safety device comprising the steps of:

(a) a user utilizing an activation means to activate said device, said activation means causing said device to emit a signal;

(b) allowing said device to remain activated for a period of time;

(c) utilizing code entry means to present a deactivate code to said device, said deactivate code presenting to said device a predetermined sequence of signals; and (d) said device ceasing emittance of said signal responsive to receiving said deactivate code.

35. The method as recited by claim 34 wherein said activation step comprises the step of squeezing said device.

36. The method as recited by claim 35 wherein said activation step comprises squeezing said device at least for a predetermined period of time.

37. The method as recited by claim 36 wherein predetermined period of time is 200 milliseconds.

38. The method as recited by claim 34 wherein said activation step comprising squeezing said device with at least a predetermined amount of pressure over a predetermined period of time.

39. The method as recited by claim 38 wherein said predetermined amount of pressure is approximately 14 pounds and said predetermined period of time is 200 milliseconds.

40. The method as recited by claim 34 wherein said activation step requires said user to utilize said activation means continuously over a predetermined period of time.

41. The method as recited by claim 40 wherein said predetermined period time is 200 milliseconds.

42. The method as recited by claim 34 wherein said step of presenting a deactivate code to said device comprises the steps of depressing a first button a predetermined number of times followed by again gripping said device.

43. The method as recited by claim 42 further comprising the step of periodically verifying the level of power stored in batteries required to operate said device, said step of periodically verifying the level of power stored in said batteries comprising the step of said user depressing said first button, said device responding by emitting a first sound if said battery power level is sufficient for operation of said device and emitting a second sound if said battery power level is not sufficient for such operation.

44. A method for activating a device for generating sound comprising the steps of:

(a) a user initiating an activation means to activate said device;

(b) monitoring said activation means for a predetermined period of time to determine if said user continues to attempt to active said device;

(c) if said user continues to attempt to activate said device over said predetermined period of time, activating said device; and (d) if said user does not continue to attempt to activate said device over said predetermined period of time, not activating said device.

45. The method as recited by claim 44 wherein said step of initiating said activation means comprises the step of squeezing said device.

46. The method as recited by claim 44 wherein said predetermined period of time is 200 milliseconds.

47. The method as recited by claim 44 wherein said apparatus for generating sound is a personal safety device.

48. An apparatus for producing a noise responsive to a stimuli having an activation means, said activation means comprising:

(a) a user accessible switch which may be held in an activate position by said user; and (b) monitoring means for monitoring the status of said switch over a period of time T, said monitoring means coupled to receive a signal from said switch indicative of the position of said switch.

49. The apparatus of claim 48 wherein said user accessible switch are grips on a dog bone shaped device.

50. The apparatus of claim 48 wherein said monitoring means comprising a microprocessor.

51. The apparatus of claim 50 wherein said period of time T is approximately 200 milliseconds.

52. The apparatus of claim 50 wherein said switch is held in an active position by said user by applying a predetermined amount of pressure to said switch.

53. The apparatus of claim 52 wherein said predetermined amount of pressure is approximately 14 pounds.

* * * * *